US006197114B1

(12) United States Patent
Rodenberger

(10) Patent No.: US 6,197,114 B1
(45) Date of Patent: Mar. 6, 2001

(54) POWER FEEDING APPARATUS HAVING AN ADJUSTABLE FEED WIDTH

(75) Inventor: Phillip Rodenberger, Muncie, IN (US)

(73) Assignee: Material Sciences Corporation, Elk Grove Village, IL (US)

( * ) Notice: Subject to any disclaimer, the term of this patent is extended or adjusted under 35 U.S.C. 154(b) by 0 days.

(21) Appl. No.: 09/186,466

(22) Filed: Nov. 5, 1998

(51) Int. Cl.[7] ..... B05C 19/04

(52) U.S. Cl. ..... 118/623; 118/629; 118/308; 118/DIG. 16; 222/368; 222/370; 399/256

(58) Field of Search ..... 118/308, 300, 118/623, 629, 627, 260, DIG. 16; 239/700, 223, 224, 675, 679, 680, 665, 655, 124, 127; 222/370, 368

(56) References Cited

U.S. PATENT DOCUMENTS

| | | | | |
|---|---|---|---|---|
| 1,032,190 | | 7/1912 | Crosby . | |
| 2,152,077 | * | 3/1939 | Meston et al. | 118/308 X |
| 3,513,810 | * | 5/1970 | Jackson | 118/308 X |
| 4,301,763 | * | 11/1981 | Goldstone et al. | 118/308 |
| 4,394,940 | | 7/1983 | Peterson | 222/276 |
| 4,502,615 | | 3/1985 | Stangl | 222/199 |
| 4,548,342 | | 10/1985 | Fisher | 222/145 |
| 4,655,161 | * | 4/1987 | Thompson | 118/308 X |
| 4,667,879 | * | 5/1987 | Muller | 239/133 |
| 4,779,521 | | 10/1988 | Brumfield | 99/289 |
| 4,779,558 | * | 10/1988 | Gabel et al. | 118/302 X |
| 5,085,372 | * | 2/1992 | Martin | 239/675 |
| 5,131,722 | | 7/1992 | DeCap | 298/35 |
| 5,170,948 | * | 12/1992 | Glick et al. | 239/666 |
| 5,305,955 | * | 4/1994 | Smitherman et al. | 239/75 |
| 5,340,030 | * | 8/1994 | Siegrist | 239/289 |
| 5,441,321 | | 8/1995 | Karpisek | 294/68.21 |
| 5,707,448 | * | 1/1998 | Cordera et al. | 118/13 |
| 5,875,882 | * | 3/1999 | Pollock | 198/674 |
| 5,895,678 | | 4/1999 | Sunter | 426/289 |
| 5,996,855 | * | 12/1999 | Alexander et al. | 222/318 |

FOREIGN PATENT DOCUMENTS

| | | |
|---|---|---|
| 1266739 | 3/1972 | (GB) . |
| 1505068 | 3/1978 | (GB) . |

* cited by examiner

*Primary Examiner*—Laura Edwards
(74) *Attorney, Agent, or Firm*—Liniak, Berenato, Longacre & White, LLC

(57) ABSTRACT

A method and system are provided for adjusting a discharge width of a powder feeder. The system includes a supply hopper that is spaced from the powder feeder. The powder feeder includes a receiving opening and a discharge opening and at least one adjustable wall. Preferably, two adjustable walls are provided. Movement of the two adjustable walls provides variations in the width of the discharge opening and therefore facilitates use of the powder feeder on target volumes or target areas having different widths. A rotatable auger brush is in communication with the supply hopper for causing powder withdrawn from the supply hopper to be transported to the powder feeder and disposed uniformly across the receiving opening of the powder feeder. The brush is immersed within the powder and extends across the receiving opening of the powder feeder, and maintains a filled level powder feeder. The powder feeder is particularly well-suited for use in a coating apparatus, as well as a dual-side coating apparatus.

36 Claims, 10 Drawing Sheets

POWER FEEDING APPARATUS HAVING AN ADJUSTABLE FEED WIDTH

BACKGROUND OF THE INVENTION

The present invention relates to a powder feeding apparatus having an adjustable feed width and preferably a cross-feed auger. The cross-feed auger of the present invention maintains the powder feeding apparatus uniformly filled with a volume of powder to be dispensed for ultimately coating a continuous substrate or discrete articles. The adjustable feed width advantageously permits uniform coatings to be applied over different widths of substrates and discrete articles.

Electrostatic coating processes have been used to modify the surface characteristics of a substrate. In order to coat the substrate, a powder atomizer is combined with a feeder to deliver measured amounts of powder into an air stream. The air stream is directed to a coating apparatus, which electrically charges the powder particles so that they become attracted to the substrate. The powder is sometimes chemically highly reactive, and typically small in size. Strong electrostatic forces charge the powder particles and thereby cause them to be attached to the substrate. The substrate frequently is in continuous strip or web form, and advances continuously across or through the coating apparatus.

Electrostatic forces can be extremely strong on small particles, equaling perhaps 10 to 1000 times their weight. The electrode is often placed 4 to 6 inches away from the substrate to permit the vast majority of the generated powder dispersion to be diffused within that bound and thus beneficially influenced by the electrostatic effects. These include the electric field, ions created by the corona discharge energetically propelled by that field toward the strip, charge transfer by some of these ions colliding with the interspersed powder, and collision and momentum transfer between the energetic ions and the interspersed powder.

The powder dispensed from the powder feeder must be dispensed at uniform rates of flow; otherwise discontinuities or lack of uniformity may develop in the coating. The height of the powder within the powder feeder should be kept constant and level, in order to maintain a uniform head pressure at the feeder inlet. Should the substrate be disposed above the powder feeder inlet, then the substrate cannot be more widely spaced therefrom because the desired electrode stand off of 4 to 6 inches would not accommodate essentially all the powder flow between the first electrode and the substrate. Maintaining and controlling the volume of powder within the powder feeder has been difficult, because of the resulting limited height available between the substrate and the feeder.

In order to evenly distribute the powder onto the substrate, the powder should be evenly distributed across the powder feeder. The discharge rate is determined by the amount of powder that must be provided per unit time to coat the substrate at its transport velocity throughout its width to the desired thickness at a given deposition efficiency. Should the powder be non-uniformly distributed within the powder feeder, then the discharge rate from the powder feeder will not be uniform. Non-uniform powder discharge from the feeder will result in discontinuous or non-uniform coatings. Thus, there is a need in the art for an apparatus and method which functions to maintain a constant volume of powder throughout a powder feeder during operation of the electrostatic powder coater.

Previous attempts to solve the problem included shaking, blowing, levitating, and pushing the powder into the feeder.

Shaking the powder along a transport path is disadvantageous, because an appropriate angle cannot be achieved in the limited space between the top of the feeder and the substrate for adequate feeding of the powder along tie range of discharge rates required to be attained and because of the strong tendency of shaking to agglomerate the powder. Blowing the powder into the powder feeder causes control over the amount of powder fed to the powder feeder to be lost, with the powder being non-uniformly distributed. Pushing the powder into the powder feeder may cause reactive powder to begin the onset of chemical changes, so that the powder will agglomerate or sinter prior to discharge and/or prior to application to the substrate. The use of a fluidization method to levitate powder in a slightly inclined trough through which the powder would flow laterally also has been attempted. This was not successful because the required inclination angle could not be obtained in the limited space between the feeder and the substrate and this method is unable to place the powder uniformly into the relatively wide brush feeder hopper across its width. Thus, there is a need in the art for an apparatus and method for maintaining a powder feeder uniformly filled, while minimizing the tendency of the powder to react.

This need has been addressed to some extent by an apparatus and method developed by Alexander et al., which was made the subject of a copending U.S. patent application Ser. No. 09/032,021 entitled Cross Feed Auger and Method filed on Feb. 27, 1998, now U.S. Pat. No. 5,996,855, the contents of which are incorporated herein by reference. Although the apparatus and method of Alexander et al. provide impressive results when the substrate has a width corresponding to the discharge width of the apparatus, the results are less than optimal when the substrate being coated has a significantly narrower width.

Narrower substrates centered in the apparatus, for example, leave substrate voids between the lateral end walls of the powder feeder and the substrate. Despite these voids, the powder feeder disclosed in the aforementioned copending patent application continues to disperse powder in the area of such voids. There is consequently a higher powder-to-substrate-surface ratio near the lateral edges of the substrate than there is near the middle of the substrate. This difference in powder-to-substrate-surface ratio tends to produce a non-uniform coating which is thicker at the edges of the substrate than it is near the middle. The non-uniform coating, however, is not the only disadvantage. The excess powder discharged into the lateral areas where it is not needed represents a waste of powder which increases material costs without any off-setting benefit.

There is consequently a need in the art for an apparatus and method capable of providing the advantages provided by the apparatus and method of Alexander et al., and also capable of providing those advantages regardless of whether a substrate significantly narrower than the width of the powder feeder is used. In this regard, there is a need in the art for a powder feeder with an adjustable discharge width.

Narrowing of the discharge width, however, without adjusting the width of the powder receptacle, will likely cause the powder at the ends of the powder receptacle to be fed at a rate which is different from that of the powder in the middle of the receptacle. Such non-uniform powder feeding would disadvantageously provide non-uniform coatings if the powder is used in a coating apparatus. There is consequently a need in the art for a powder feeder having an adjustable discharge width and also having a powder receptacle of adjustable width. Such an arrangement would permit adjustments of the receptacle width to be made in a corresponding manner when any adjustments of the discharge width are made.

SUMMARY OF THE INVENTION

A primary object of the present invention is to overcome the shortcomings in the above arrangements by providing, among other things, an apparatus capable of dispersing powder uniformly over a substrate regardless of whether the substrate is significantly narrower than the apparatus.

Yet another object of the present invention is to provide a powder feeding apparatus having a discharge of adjustable width.

Still another object of the present invention is to provide a powder feeder having a discharge of adjustable width and a powder receptacle of adjustable width.

To achieve these and other objects, the present invention includes a powder feeder for feeding powder from a powder supply to a powder discharging device. The powder feeder includes a powder receptacle and a rotatable auger brush. The powder receptacle has an inlet, a discharge directed toward the powder discharging device, a stationary wall portion and at least one adjustable wall which is movable with respect to the stationary wall portion to adjust a width of the discharge. The rotatable auger brush is in communication with the powder supply and extends through the inlet of the powder receptacle. The auger brush is rotated to withdraw powder from the powder supply and transport the powder through the inlet of the powder feeder. The term "withdraw" is used herein in its broadest sense. It encompasses pushing, pulling and any other method of taking the powder away from the hopper.

Preferably, a drive mechanism is operatively connected to the rotatable auger brush so as to rotate the auger brush at a rotational speed which causes the powder to be dispensed uniformly across the powder receptacle. The rotatable auger brush preferably is horizontally arranged in the powder receptacle and is immersed in the powder.

Each adjustable wall preferably includes a powder flow tube in communication with the powder receptacle and extending away from the powder receptacle from an outside surface of the respective adjustable wall. Preferably, the powder flow tube is fixed to its respective adjustable wall. The rotatable auger brush is arranged so as to extend through the powder flow tube and transport powder therethrough.

A stationary feed tube may be arranged so that the powder flow tube is telescopically movable along a portion of the stationary feed tube. The stationary feed tube preferably is disposed around a portion of the rotatable auger brush so that the rotatable auger brush transports powder through the stationary feed tube.

Preferably, one combination of the stationary feed tube and powder flow tube extends toward the powder supply and defines a telescopic powder feed path of adjustable length which compensates for movement of a respective adjustable wall. In addition, another combination of the stationary feed tube and the powder flow tube extends generally away from the powder supply toward a powder reclamation apparatus to define a telescopic powder reclamation path of adjustable length which compensates for movement of a respective adjustable wall.

The powder receptacle preferably has an elongated shape of substantially constant cross section over a length thereof At least-one adjustable wall is disposed near a first longitudinal end of the powder feeder, for selective movement linearly toward an opposite longitudinal end of the powder feeder to thereby selectively adjust the width of the discharge.

First and second end walls preferably are located at the first longitudinal end and the opposite longitudinal end, respectively, of the powder feeder for delimiting a powder containment area. One of the first and second end walls preferably has at least one aperture through which at least one control rod extends. Each control rod is connected at least indirectly to one adjustable wall so that actuation of the control rod in a first direction moves the adjustable wall inwardly to decrease the width of the discharge and actuation of the control rod in a second, opposite direction moves the adjustable wall outwardly to increase the width of the discharge.

A brush may be rotatably mounted at the discharge, for metering powder out through the discharge at an adjustable rate. Preferably, this metering brush is substantially parallel to the rotatable auger brush. The rate is adjustable by selectively adjusting a rotational speed of the metering brush.

The powder feeder preferably includes, or is connected to, the discharging device. The discharging device itself may include an atomizing brush rotatably mounted adjacent to and substantially parallel to the metering brush. The atomizing brush receives the powder from the metering brush and propels the powder in a substantially uniformly distributed manner toward a target volume.

The present invention also provides a powder feeder for feeding powder from a powder supply to a powder discharging device, wherein the powder receptacle of the powder feeder has two adjustable walls. The powder feeder includes a powder receptacle and a rotatable auger brush. The powder receptacle has an inlet, a discharge directed toward the powder discharging device, a stationary wall portion, and two adjustable walls disposed on opposite ends of the powder receptacle. Each of the two adjustable walls is movable with respect to the stationary wall portion to adjust a width of the discharge. The rotatable auger brush is in communication with the powder supply and extends through the inlet of the powder receptacle. Powder is withdrawn by the rotatable auger brush from the powder supply and is transported through the inlet of the powder feeder.

The present invention also provides a powder supply and dispersing system comprising a powder supply hopper, a powder discharging device, and a powder feeder. The powder supply hopper holds a supply of powder. The powder discharging device disperses the powder in a substantially uniform manner across a target volume. The powder discharging device is connected to the powder supply hopper by the powder feeder. The powder feeder feeds the powder from the powder supply hopper to the powder discharging device and includes a powder receptacle and a rotatable auger brush. The powder receptacle has an inlet, a discharge directed toward the powder discharging device, a stationary wall portion, and at least one adjustable wall which is movable with respect to the stationary wall portion to adjust a width of the discharge. The rotatable auger brush is in communication with the powder supply hopper and extends through the inlet of the powder receptacle. Powder is withdrawn by the rotatable auger brush from the powder supply hopper and is transported through the inlet of the powder feeder.

Also provided by the present invention is a powder supply and dispersing system wherein the powder receptacle of the powder feeder has two adjustable walls. The powder supply and dispersing system comprises a powder supply hopper, a powder discharging device, and a powder feeder. The powder supply hopper holds a supply of powder. The powder discharging device disperses the powder in a substantially uniform manner across a target volume. The powder discharging device is connected to the powder supply hopper by the powder feeder. The powder feeder feeds powder from the powder supply hopper to the powder discharging device, and includes a powder receptacle and a rotatable auger brush. The powder receptacle has an inlet, a discharge directed toward the powder discharging device, a stationary wall portion and two adjustable walls disposed on opposite ends of the powder receptacle. Each of the two adjustable walls is movable with respect to the stationary wall portion to adjust a width of the discharge. The rotatable auger brush is in communication with the powder supply hopper and extends through the inlet of the powder receptacle. Powder is withdrawn by the rotatable auger brush from the powder supply hopper and is transported through the inlet of the powder feeder.

The present invention also provides a coating apparatus for applying a uniform coating on a target web. The coating apparatus comprises a powder supply hopper, a powder discharging device, an electrostatic coater, and a powder feeder. The powder supply hopper holds a supply of powder. The powder discharging device disperses the powder in a substantially uniform manner across a target volume near the target web. The electrostatic coater is located in the target volume and electrostatically coats the target web in a substantially uniform manner using the powder which is dispersed by the powder discharging device. The powder feeder connects the powder supply hopper to the powder discharging device. Powder is fed by the powder feeder from the powder supply hopper to the powder discharging device. The powder feeder includes a powder receptacle and a rotatable auger brush. The powder receptacle has an inlet, a discharge directed toward the powder discharging device, a stationary wall portion and at least one adjustable wall which is movable with respect to the stationary wall portion to adjust a width of the discharge. The rotatable auger brush is in communication with the powder supply hopper and extends through the inlet of the powder receptacle. Powder is withdrawn by the rotatable auger brush from the powder supply hopper and is transported through the inlet of the powder feeder.

Also provided by the present invention is a coating apparatus wherein the powder receptacle of the powder feeder has two adjustable walls. The coating apparatus applies a uniform coating on a target web, and comprises a powder supply hopper, a powder discharging device, an electrostatic coater, and a powder feeder. The powder supply hopper holds a supply of powder. The powder discharging device disperses the powder in a substantially uniform manner across a target volume near the target web. The electrostatic coater is located in the target volume and electrostatically coats the target web in a substantially uniform manner using the powder which is dispersed by the powder discharging device. The powder feeder connects the powder supply hopper to the powder discharging device. Powder is fed by the powder feeder from the powder supply hopper to the powder discharging device. The powder feeder includes a powder receptacle and a rotatable auger brush. The powder receptacle has an inlet, a discharge directed toward the powder discharging device, a stationary wall portion and two adjustable walls disposed on opposite ends of the powder receptacle. Each of the two adjustable walls is movable with respect to the stationary wall portion to adjust a width of the discharge. The rotatable auger brush is in communication with the powder supply hopper and extends through the inlet of the powder receptacle. Powder is withdrawn by the auger brush from the powder supply hopper and is transported through the inlet of the powder feeder.

The present invention also provides a dual-side coating apparatus for applying a uniform coating on opposite first and second sides of a target web. The dual-side coating apparatus comprises at least one powder supply hopper, first and second powder discharging devices, first and second electrostatic coaters, and first and second powder feeders. Each powder supply hopper holds a supply of powder. The first powder discharging device disperses the powder in a substantially uniform manner across a first target volume on the first side of the target web. The first electrostatic coater is located in the first target volume and electrostatically coats the first side of the target web in a substantially uniform manner using the powder which is dispersed by the first powder discharging device. The first powder feeder connects the powder supply hopper to the first powder discharging device and feeds powder from the powder supply hopper to the first powder discharging device. The first powder feeder includes a first powder receptacle and a first rotatable auger brush. The first powder receptacle has an inlet, a discharge directed toward the first powder discharging device, a stationary wall portion and at least one adjustable wall which is movable with respect to the stationary wall portion to adjust a width of the discharge. The first rotatable auger brush is in communication with the powder supply hopper and extends through the inlet of the first powder receptacle. Powder is withdrawn by the first rotatable auger brush from the powder supply hopper and is transported through the inlet of the first powder feeder. The second powder discharging device disperses the powder in a substantially uniform manner across a second target volume on the second side of the target web. The second electrostatic coater is located in the second target volume and electrostatically coats the second side of the target web in a substantially uniform manner using the powder which is dispersed by the second powder discharging device. The second powder feeder connects the powder supply hopper to the second powder discharging device, and feeds powder from the powder supply hopper to the second powder discharging device. Preferably, the second powder feeder has components similar or identical to those of the first powder feeder.

Although one powder supply hopper may suffice, the use of two powder supply hoppers provides a more versatile arrangement. In particular, by providing one hopper for each powder feeder, each powder feeder can draw from a different supply of powder. This is especially desirable when different coatings are desired on the opposite sides of the target web.

Also provided by the present invention is a dual-side coating apparatus for applying a uniform coating on opposite first and second sides of a target web, wherein a powder receptacle in a first powder feeder of the dual-side coating apparatus includes two adjustable walls. The dual-side coating apparatus comprises at least one powder supply hopper, first and second powder discharging devices, first and second electrostatic coaters, and first and second powder feeders. The powder supply hopper(s) hold(s) a supply of powder. The first powder discharging device disperses the powder in a substantially uniform manner across a first target volume on the first side of the target web. The first electrostatic coater is located in the first target volume and electrostatically coats the first side of the target web in a substantially uniform manner using the powder which is dispersed by the first powder discharging device. The first powder feeder connects the powder supply hopper to the first powder discharging device and feeds powder from the powder supply hopper to the first powder discharging device. The first powder feeder includes a first powder receptacle and a first rotatable auger brush. The first powder receptacle has an inlet, a discharge directed toward the powder discharging device, a stationary wall portion and two adjustable walls disposed on opposite ends of the first powder receptacle. Each of the two adjustable walls is movable with respect to the stationary wall portion to adjust a width of the discharge. The first rotatable auger brush is in communication with the powder supply hopper and extends through the inlet of the first powder receptacle. Powder is withdrawn from the powder supply hopper by the first rotatable auger brush and is transported through the inlet of the first powder feeder. The second powder discharging device disperses the powder in a substantially uniform manner across a second target volume on the second side of the target web. The second electrostatic coater is located in the second target volume and electrostatically coats the second side of the target web in a substantially uniform manner using the powder which is dispersed by the second powder discharging device. The second powder feeder connects the powder supply hopper to the second powder discharging device, and feeds powder from the powder supply hopper to the second powder discharging device. Preferably, the second powder feeder has components similar or identical to those of the first powder feeder.

Although one powder supply hopper may suffice, the use of two powder supply hoppers provides a more versatile arrangement, especially since each hopper can supply a different type of powder.

The present invention also provides a powder application system comprising a powder feeder atomizer and an application chamber. The powder feeder atomizer includes a supply hopper, a powder feeder, a rotatable auger brush, a drive and at least one adjustable wall. The powder feeder is spaced from the supply hopper and has an inlet and a discharge. The rotatable auger brush is in communication with the supply hopper and extends across the inlet for causing powder to be withdrawn from the supply hopper and to be transported longitudinally to the powder feeder and to be dispensed level across the powder feeder through the inlet. The drive rotates the brush. The adjustable wall is movable to adjust a width of the discharge. The application chamber is in communication with the powder feeder atomizer. The application chamber has a substrate inlet aligned with a substrate exit, a plurality of charging electrodes arrayed in the chamber for charging powder supplied by the powder feeder atomizer, and a plurality of baffles disposed within the chamber interposed with the electrodes for shaping a dispersion of powder and an electric field resulting from the electrodes so that powder is attracted to and caused to be attached to the conductive substrate disposed within the chamber.

The present invention also provides a powder feeder for feeding powder from a powder supply to a powder discharging device. The powder feeder comprises a powder receptacle having an inlet, a discharge directed toward the powder discharging device, a stationary wall portion, and at least one adjustable wall which is movable linearly along the stationary wall portion to adjust a width of the discharge.

Also provided by the present invention is a powder feeder for feeding powder from a powder supply to a powder discharging device, wherein the powder receptacle includes two adjustable walls. The powder feeder comprises a powder receptacle having an inlet, a discharge directed toward the powder discharging device, a stationary wall portion, and the two adjustable walls. The two adjustable walls are movable linearly toward and away front one another along the stationary wall portion to adjust a width of the discharge.

The present invention also includes a method for adjusting a powder feeder to accommodate different sizes of target areas, wherein the powder feeder includes a powder receptacle with at least one adjustable wall. The method includes the steps of determining target area which is to receive the powder, and moving the adjustable wall(s) of the powder receptacle so that a discharge of the powder receptacle has a width substantially corresponding to a width of the target area.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE INVENTION

Figure 1:
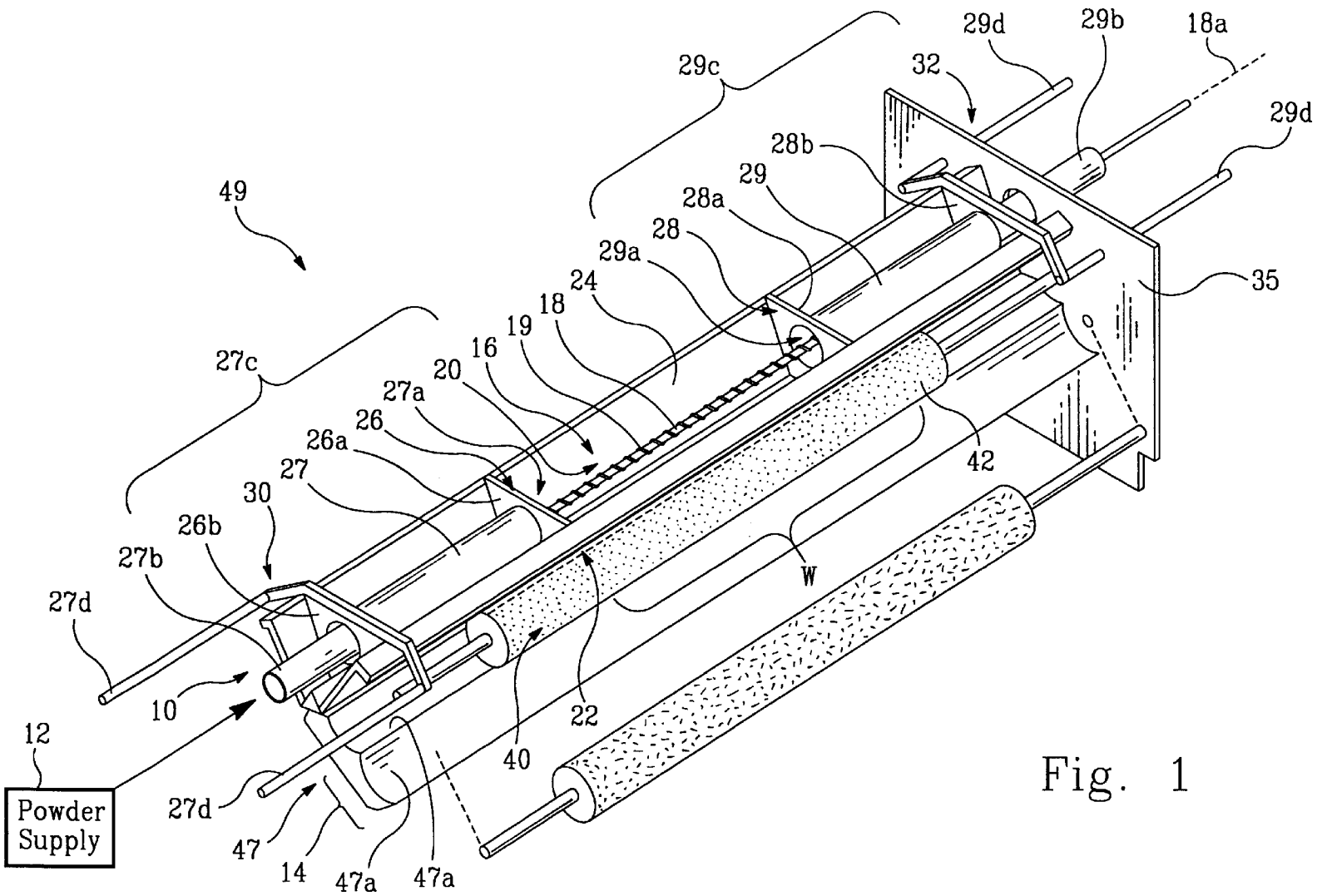
FIG. 1 is a perspective, partially exploded view of a powder feeder according to a preferred embodiment of the present invention.
Figure 2:
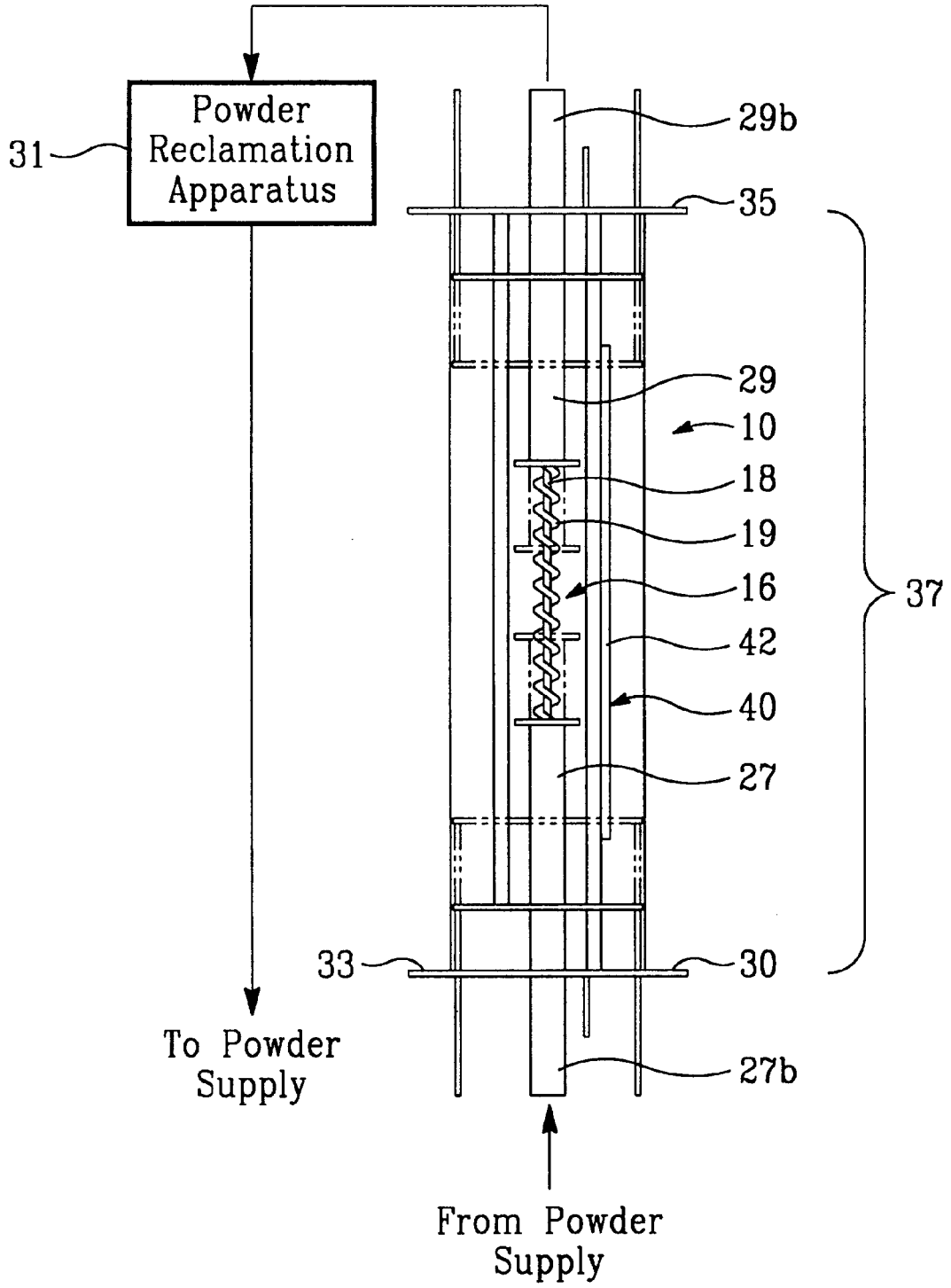
FIG. 2 is a plan view of the powder feeder illustrated in FIG. 1.

As shown in FIGS. 1–4, a powder feeder 10 is provided for feeding powder (not shown) from a powder supply 12 to a powder discharging device 14. The powder feeder 10 includes a powder receptacle 16 and a rotatable auger brush 18. The auger brush 18 is rotated about an axis 18A of rotation. The rotatable auger brush 18 preferably has a plurality of bristles 18B disposed helically in flights 19. The helical flights 19 provide an auger configuration. The plurality of bristles 18B which define the schematically illustrated helical flights 19 extend radially out from the axis 18A of rotation. Preferably, the bristles 18B have a thickness about equal to a particle diameter of the powder.

The auger configuration of the brush 18, however, need not be defined by bristles 18B. To the contrary, the brush 18 may be defined using auger means other than bristles. In this regard, the term "brush", as used herein, also encompasses non-bristle-containing augers which brush against the powder as the powder is conveyed.

Though the rotatable auger brush 18 provides significant advantages as will be described hereinafter, it is not necessary in several applications of the present invention. It can be omitted, for example, whenever uniformity of powder distribution in the powder receptacle 16 is not important, or where alternative means are provided for achieving such uniformity.

The powder receptacle 16 has an inlet 20, a discharge 22 directed toward the powder discharging device 14, a stationary wall portion 24, and at least one adjustable wall 26,28 which is movable along (or with respect to) stationary wall portion 24 to adjust a width (W) of the discharge 22. The powder receptacle 16 has an elongated shape of substantially constant cross section over a length thereof.

Two adjustable walls 26,28 are provided in the illustrated embodiment. The two adjustable walls 26,28 are near opposite longitudinal ends 30, 32 of the powder feeder 10 and are selectively movable linearly toward and away from the ends 30,32 and each other, to adjust the width (W) of the discharge 22.

Each adjustable wall 26,28 preferably includes a respective powder flow tube 27,29 in communication with the powder receptacle 16. One end of each powder flow tube 27,29 is fixed to its respective adjustable wall 26,28 for movement therewith. Another portion or end of each powder flow tube 27,29 is fixed to and supported by a slidable bulkhead 26B,28B. The bulkheads 26B,28B are slidable linearly along the stationary wall portion 24 of the powder receptacle 16.

At least one control rod 27D,29D is connected to each slidable bulkhead 26B,28B so that actuation of the control rod 27D,29D in a first direction moves the respective powder flow tube 27,29 and its associated adjustable wall 26,28 inwardly to decrease the width of the discharge 22, whereas actuation of the control rod 27D, 29D in a second, opposite direction moves the same powder flow tube 27,29 and adjustable wall 26,28 outwardly to increase the width of the discharge 22. Although two control rods 27D,29D are connected to each slidable bulkhead 26B,28B in the illustrated embodiment, it is understood that the present invention also may be practiced using only one control rod 27D,29D for each bulkhead 26B,28B.

The control rods 27D,29D extend through respective apertures in first and second end walls 33,35. The first and second end walls 33,35 are located at the first longitudinal end 30 and the opposite longitudinal end 32, respectively, of the powder feeder 10. The first and second end walls 33,35 delimit a powder containment area 37 and provide a barrier through which the powder cannot escape.

Openings 27A and 29A are provided from the powder receptacle 16 into the respective powder flow tubes 27,29. The powder flow tubes 27,29 extend from outside surfaces 26A,28A of the adjustable walls 26,28 in opposite directions generally away from the powder receptacle 16. Preferably, each powder flow tube 27,29 is fixed to its respective adjustable wall 26,28 for movement therewith.

Associated with each powder flow tube 27,29 is a respective stationary feed tube 27B,29B. Each stationary feed tube 27B,29B is arranged so that the powder flow tube 27,29 associated therewith is telescopically movable along a portion of the stationary feed tube 27B,29B. The stationary feed tubes 27B,29B and powder flow tubes 27,29 are disposed around portions of the rotatable auger brush 18.

One of the stationary feed tubes 27B and one of the powder flow tubes 27 extend toward the powder supply and together define a telescopic powder feed path 27C of adjustable length. The length of the telescopic powder feed path 27C may be adjusted to compensate for linear movement of the adjustable wall 26.

The other stationary feed tube 29B and the other powder flow tube 29 extend toward a powder reclamation apparatus 31 and together define a telescopic powder reclamation path 29C of adjustable length. The length of the telescopic reclamation path 29C may be adjusted to compensate for linear movement of the adjustable wall 28.

Extending through the powder flow tubes 27,29 and through the stationary feed tubes 27B,29B is the rotatable auger brush 18. The auger brush 18 also extends through the inlet 20 of the powder receptacle 16 and is in communication with the powder supply 12.

When the brush 18 is rotated, it withdraws powder from the powder supply 12 and into the stationary feed tube 27B. This powder is transported by the brush 18 through the stationary feed tube 27B and through the powder flow tube 27. The powder then flows out through the opening 27A into the inlet 20 of the powder feeder 10. In this manner, the powder fills the powder receptacle 16 between the adjustable walls 26,28, at least to the level of the rotatable auger brush 18.

Excess powder drawn into the inlet 20 is transported by the brush 18 out of the powder receptacle 16 through the opening 29A. The excess powder then flows through the powder flow tube 29 and stationary feed tube 29B to the reclamation apparatus 31. The reclamation apparatus then recycles the powder and returns the recycled powder to the powder supply 12.

If recycling of the powder is not desirable, the reclamation apparatus can be eliminated in favor of a disposal path. When the disposal path is used, the excess powder flowing through the stationary feed tube 29B is discarded at the end of the disposal path.

Figure 4:
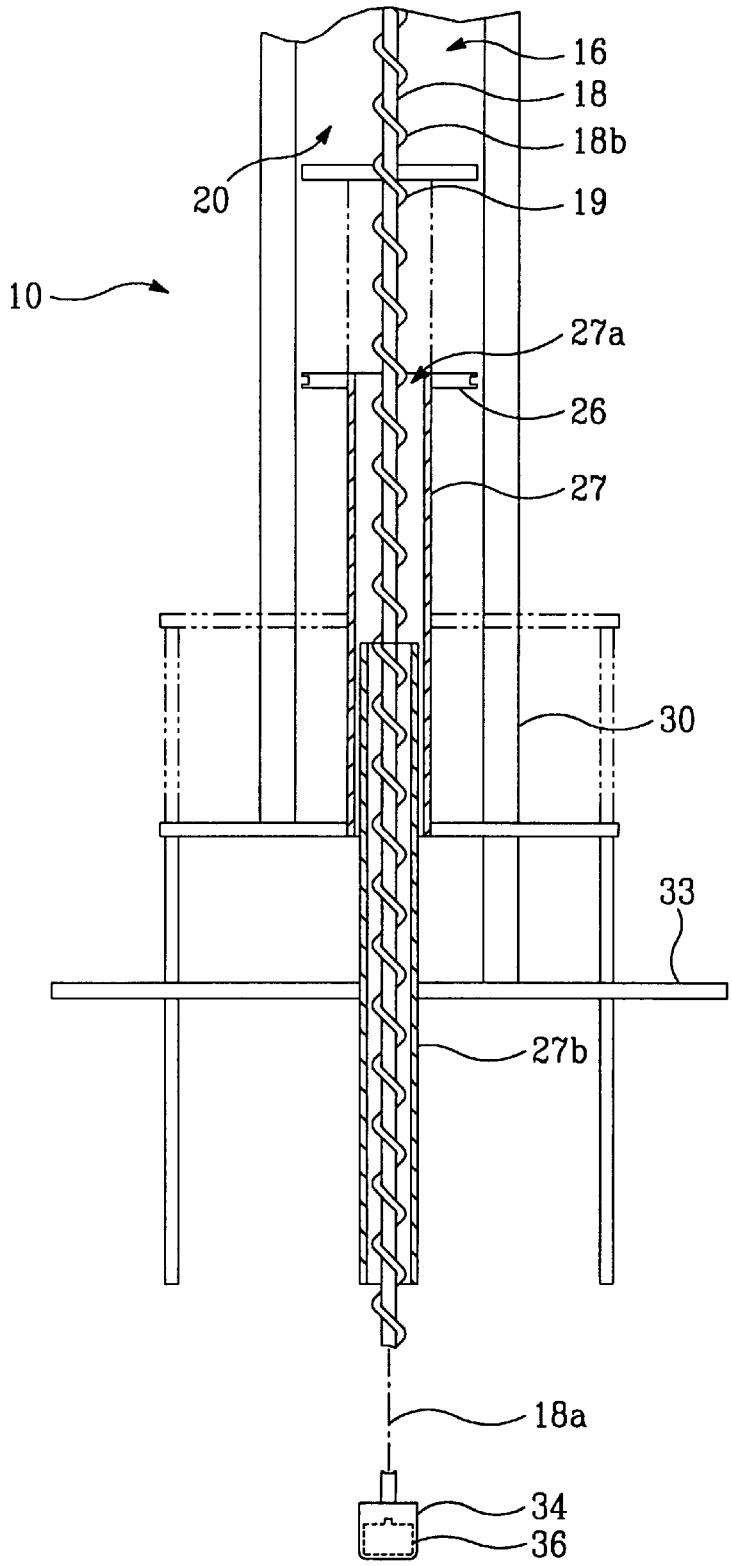
FIG. 4 is a sectional view of one side of the powder feeder which is illustrated in FIGS. 1–3 when incorporated into a coating apparatus.

Preferably, a drive mechanism 34 is operatively connected to the rotatable auger brush 18. As illustrated in FIG. 4, the drive mechanism 34 preferably includes an electric motor 36. The drive mechanism 34 rotates the auger brush 18 at a rotational speed which causes the powder to be dispensed uniformly across the powder receptacle 16, by feeding excess powder to that being withdrawn by metering brush 40. By drawing the powder across the inlet 20, the rotatable auger brush 18 fills any valleys which might otherwise develop on the top surface of the powder.

Figure 3:
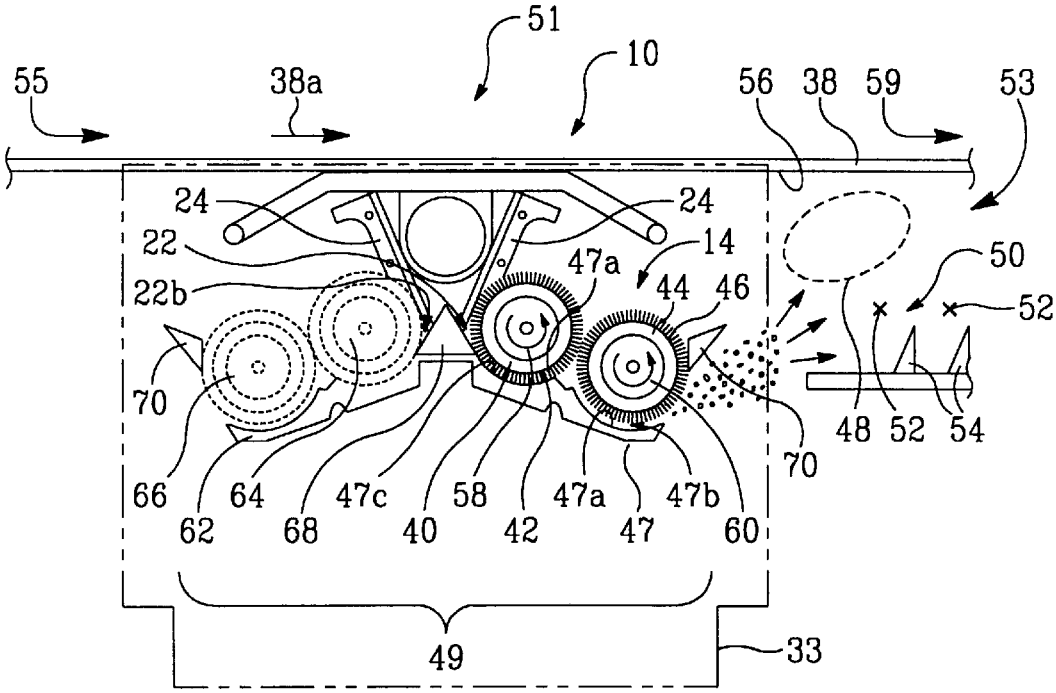
FIG. 3 is a side view of the powder feeder which is illustrated in FIGS. 1 and 2.

The auger brush 18 preferably is horizontally arranged in the powder receptacle 16 and is immersed in the powder. The powder provided by the powder supply 12 is defined by particulates, such as thermoset, thermoplastic, and other finely divided material, to be electrostatically applied to a bottom surface of a target web 38. The target web 38 is shown in FIG. 3, and is continuously conveyed over the powder feeder 10 in a generally horizontal direction. The direction of travel for the target web 38 is denoted by an arrow 38A.

A metering brush 40 is rotatably mounted at the discharge 22 of the receptacle 16. The metering brush 40 includes a plurality of bristles 42 which engage the powder at the discharge 22 and feed the powder out through the discharge 22 at an adjustable rate. The rate is adjusted by selectively adjusting a rotational speed of the metering brush 40. Preferably, the metering brush 40 is substantially parallel to the rotatable auger brush 18.

As shown in FIG. 3, the discharging device 14 preferably is arranged as part of the powder feeder 10. The discharging device 14 includes an atomizing brush 44 rotatably mounted adjacent to and substantially parallel to the metering brush 40. The atomizing brush 44 includes a plurality of bristles 46. The bristles 46 engage the powder from the metering brush 40 as the metering brush 40 rotates. Rotation of the atomizing brush 44 propels the powder provided by the metering brush 40 off of a wing 70 in a substantially uniformly distributed manner toward a target volume 48. Typically, the atomizing brush 44 rotates at a much faster rate than the metering brush 40 because the purpose of the atomizing brush 44 is to deagglomerate and uniformly disperse the powder, whereas the metering brush 40 rotates only at a speed sufficient to provide the desired rate of powder flow toward the atomizing brush 44.

Preferably, the discharging device 14 further includes a pan 47. The pan 47 is provided coextensively with the metering brush 40 and the atomizing brush 44. The pan 47 includes recesses 47A which accommodate the metering brush 40 and the atomizing brush 44. A venturi 47B is provided between the pan 47 and the atomizing brush 44. A metering path 47C is defined between the pan 47 and the metering brush 40.

As illustrated in FIG. 1, a powder supply and dispersing system 49 may be defined by combining the powder discharging device 14 and the powder feeder 10 with the powder supply 12. Preferably, the powder supply 12 includes a powder supply hopper 76. Examples of the powder supply hopper 76 are illustrated in the alternative embodiments of FIGS. 7–10. The hopper 76 holds a supply of powder which is to be fed to the discharging device 14.

According to the powder supply and dispersing system shown in FIG. 1, the powder feeder 10 connects the powder supply to the powder discharging device 14. The powder feeder 10 feeds powder from the powder supply hopper 76 to the powder discharging device 14. The powder discharging device 14 then disperses the powder in a substantially uniform manner across the target volume 48.

As best shown in FIG. 3, the powder supply and dispersing system 49 of the present invention may be incorporated into a coating apparatus 51 which applies a uniform coating on the target web 38. While the illustrated embodiment is arranged below the target web 38 to provide the coating on that side of the web 38, it is understood that the coating apparatus 51 alternatively can be arranged above the web 38 if the coating is desired on that side of the web 38 or along side the web if the substrate is vertically arranged.

The coating apparatus 51 includes an electrostatic coater 50 which is located below the target volume 48 of the powder supply and dispersing system 49. The electrostatic coater 50 includes a plurality of electrodes 52. The electrodes 52 are arrayed below the target volume 48 and serve to charge the powder as it is dispersed into the target volume 48 by the atomizing brush 44. When charged by the electrodes 52, the powder becomes attracted to the target web 38 and therefore coats the surface 56 of the web 38. The electrostatic coater 50 thereby electrostatically coats the target web 38 in a substantially uniform manner using the powder which is dispersed by the powder discharging device 14 into the target volume 48.

A plurality of baffles 54 are disposed within the target volume 48 and are interposed with the electrodes 52. The baffles 54 shape the dispersion of powder and the electric field emanating from the charged electrodes 52 so that the powder is attracted to and caused to be attached to the target web 38 in a desirably uniform and efficient manner.

The foregoing arrangement provides an application chamber 53 which is delimited by the end walls 33,35. The application chamber 53 is in communication with the atomizing brush 44 and has a web inlet 55 and a web exit 59. The web inlet 55 and web exit 59 are aligned with one another. The electrodes 52 are arrayed in the application chamber 53. The baffles 54 are disposed within the chamber 53, interposed with the electrodes 52 for shaping a dispersion of powder and an electric field resulting from the charged electrodes 52 so that powder is attracted to and caused to be attached to the conductive web 38.

The illustrated coating apparatus 51 can accommodate target webs 38 of different widths without compromising the uniformity of the coating. In particular, the width of the powder receptacle is adjusted by moving the adjustable walls 26,28 linearly toward or away from one another to achieve a discharge width (W) which corresponds to the width of the target web 38.

If the target web 38 to be coated is wider than a previously coated web 38, the adjustable walls 26,28 are moved linearly away from each other. This increases the width (W) of the discharge 22 and therefore provides a substantially uniform distribution of powder over the area defined by the wider target web 38.

If the target web 38, by contrast, is narrower than the previously coated target web, the adjustable walls 26,28 are moved linearly toward each other to narrow the width (W) of the discharge 22. As a result, the powder is dispersed uniformly over the narrower area defined by the narrow target web 38.

Preferably, the target web 38 remains centered as it is conveyed through the coating apparatus 51. Linear movement of the adjustable walls 26,28 therefore is carried out symmetrically. More specifically, when one wall 26,28 is moved, the other wall 28,26 is lo moved the same distance but in an opposite direction. Both walls 26,28 therefore are moved to positions which are substantially equidistant from the center of the powder receptacle 16. Such symmetrical movement is carried out manually using the illustrated control rods 27D,29D, or can be carried out using an automatic adjustment device (not shown) with a suitable drive mechanism (not shown).

In order to maintain the aforementioned symmetry with respect to the center of the receptacle 16, the adjustable walls 26,28 can be coupled to one another using an appropriate coupling mechanism (not shown). In particular, the coupling mechanism is arranged so that movement of one of the adjusting walls 26,28 results in corresponding movement of the other wall 26,28. The coupling provided by the coupling mechanism can be made substantially permanent, or alternatively, the coupling mechanism can be provided with an override mechanism (not shown) which permits uncoupling of the adjustable walls 26,28 and thereby permits independent movement thereof.

Although the adjustable walls 26,28 represent a preferred mechanism for adjusting the discharge width (W), it is understood that alternative mechanisms can be provided to achieve similar results. The discharge width (W) can be selectively narrowed, for example, by keeping the walls 26,28 stationary and sliding obstruction plates (not shown) inwardly from the opposite ends 30,32 so that the obstruction plates block the ends of the discharge width (W) and thereby narrow the discharge width (W) by a selectively chosen amount. Such an arrangement, however, does not prevent powder from entering the portions of the receptacle 16 which are located immediately above the obstruction plates. As a result, excess powder accumulates in the ends of the receptacle 16, especially immediately over the obstruction plates. With certain powders, however, such accumulation of the powder can cause agglomeration. In addition, the accumulation of powder may provide distribution irregularities over the length of the metering brush 40. These irregularities, in turn, can cause uneven dispersement of the powder across the target volume 48 and coatings which are not uniformly applied to the target substrate 38.

Since the adjustable walls 26,28 shown in FIGS. 1–4 are adjusted to keep the size of the receptacle 16 consistent with the width of the discharge 22, there is no accumulation of excess powder at the ends of the illustrated receptacle 16. The illustrated receptacle 16 therefore avoids the disadvantages associated with an obstruction plate-based arrangement.

The foregoing and other advantages of the present invention will become more readily apparent from the following description of how the embodiment in FIGS. 1–4 operates.

Initially, the adjustable walls 26,28 are moved to positions substantially aligned with the lateral edges of the target web 38. This movement provides a corresponding adjustment of the discharge width (W). A wide limit to this movement is defined at the point where the bulkheads 26B,28B engage the end walls 33,35. A narrow limit is defined at the point where the adjustable walls 26,28 engage one another and/or at the telescoping limits of the telescopic powder feed path 27C and of the telescopic powder reclamation path 29C.

Since the stationary feed tubes 27B, 29B and powder flow tubes 27,29 are telescopically arranged with respect to one another, the discharge width adjustment also achieves a corresponding adjustment in the length of the telescopic powder feed path 27C and in the length of the telescopic powder reclamation path 29C.

Once the appropriate adjustments have been made, the target web 38 is fed through the coating apparatus 51. The auger brush 18 is simultaneously rotated to draw powder from the powder supply hopper into the stationary feed tube 27B, through the powder flow tube 27, and out through the opening 27A. As the powder exits the powder flow tube 27 via the opening 27A, it is evenly distributed through the inlet 20 of the powder receptacle 16.

Excess powder in the receptacle 16 is drawn out of the receptacle 16 by rotation of the brush 18. In particular, the brush 18 draws the powder out through the opening 29A and through the telescopic powder reclamation path 29C, to the reclamation apparatus 31 where it is recycled or to a disposal site where it will be discarded.

As the auger brush 18 rotates, the metering brush 40 also rotates. The metering brush 40 rotates in the direction denoted by arrow 58. The rotational speed of the metering brush 40 is selected to achieve a desired rate of powder flow to the discharging device 14 through the discharge 22. In particular, the metering brush 40 draws out powder from the adjusted discharge 22 and feeds this powder toward the atomizer brush 44.

The atomizer brush 44 rotates in the direction denoted by arrow 60, typically at a very much faster rate than the metering brush 40. This rotation creates a venturi effect in the venturi 47B between the atomizer brush 44 and the pan 47. This venturi effect draws the powder which is provided at a metered rate by the metering brush 40 into the venturi 47B. The atomizer brush 44 then disperses this powder uniformly off of wing 70 into the target volume 48.

As the powder enters the target volume 48, the electrostatic coater 50 causes the powder to become electrostatically attracted to the grounded conductive target web 38. Because of this attraction, the powder from the discharging device 14 coats the target web 38. A uniform powder coating thereby is provided on the target web 38, as the target web 38 progressively advances through the coater 50.

Notably, the coating apparatus 51 is able to feed, disperse and apply the powder to the bottom surface 56 of the target web 38 without having the powder supply hopper located under the target web 38. The coating apparatus 51, therefore, advantageously provides the powder coating uniformly on the bottom surface 56 while maintaining only a limited amount of vertical clearance between the web 38 and the point where the powder is dispersed by the discharging device 14.

While the foregoing description relates to a single coating, it is understood that the illustrated apparatus and method can be adapted to provide multiple coatings. Moreover, as will be described hereinafter, the illustrated apparatus and method also can be adapted to provide coatings on both sides of the target web 38.

With regard to the application of multiple coatings, the pan 47 illustrated in FIG. 3 can include an auxiliary branch 62 capable of accommodating both an additional metering brush 64 and an additional atomizing brush 66, both of which rotate in an opposite sense from their counterparts 40,44. A divider 68 of triangular cross section is provided over the pan 47. The divider 68 separates the powder and directs it not only into the discharge 22, but also into an additional discharge 22B. The resulting dual-discharge arrangement can be used to dispense powder into another target volume 48C and apply two layers of coating on the same side of the target web 38.

Figure 5:
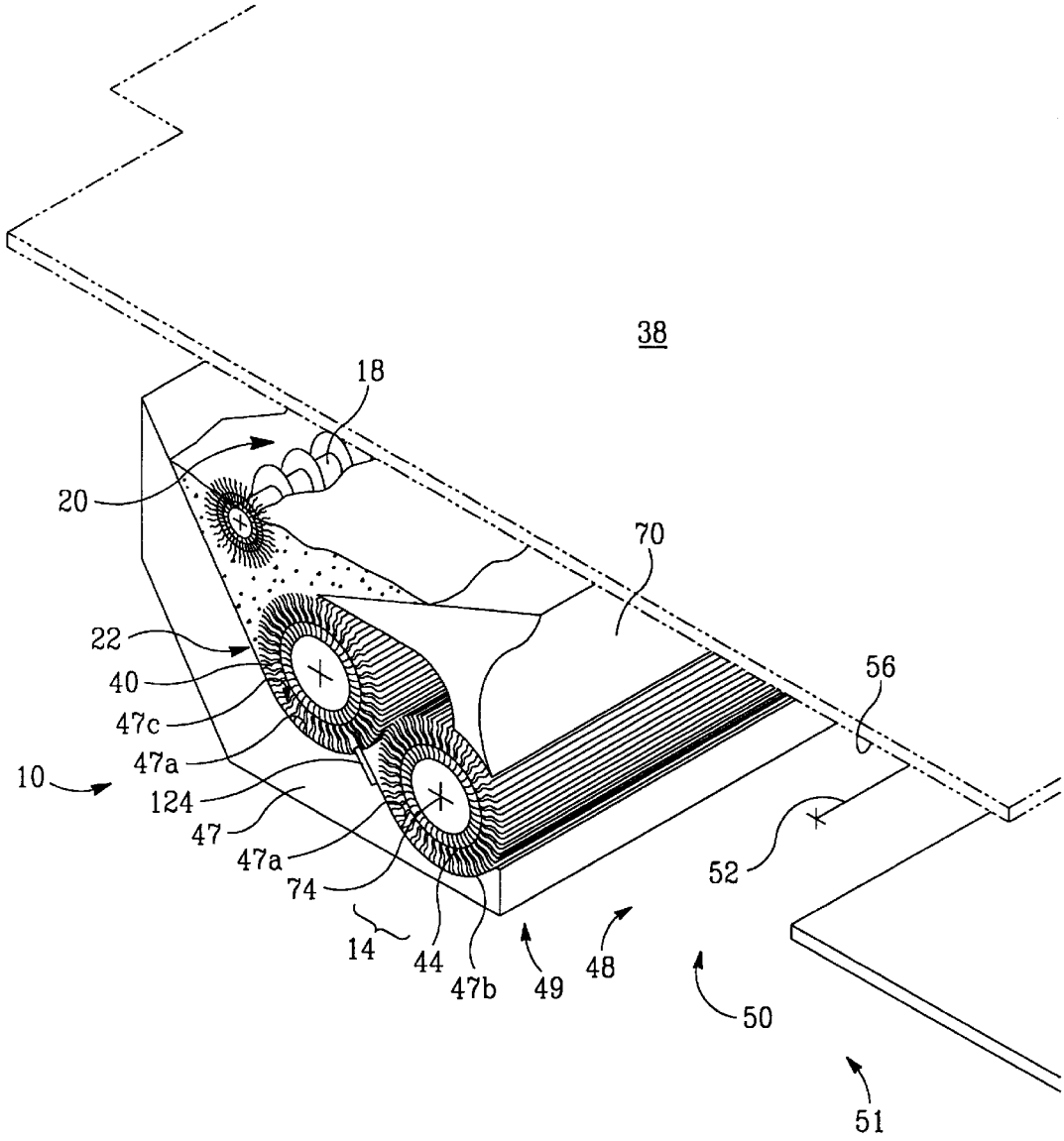
FIG. 5 is a fragmentary perspective view of an electrostatic coating apparatus according to the present invention.
Figure 6:
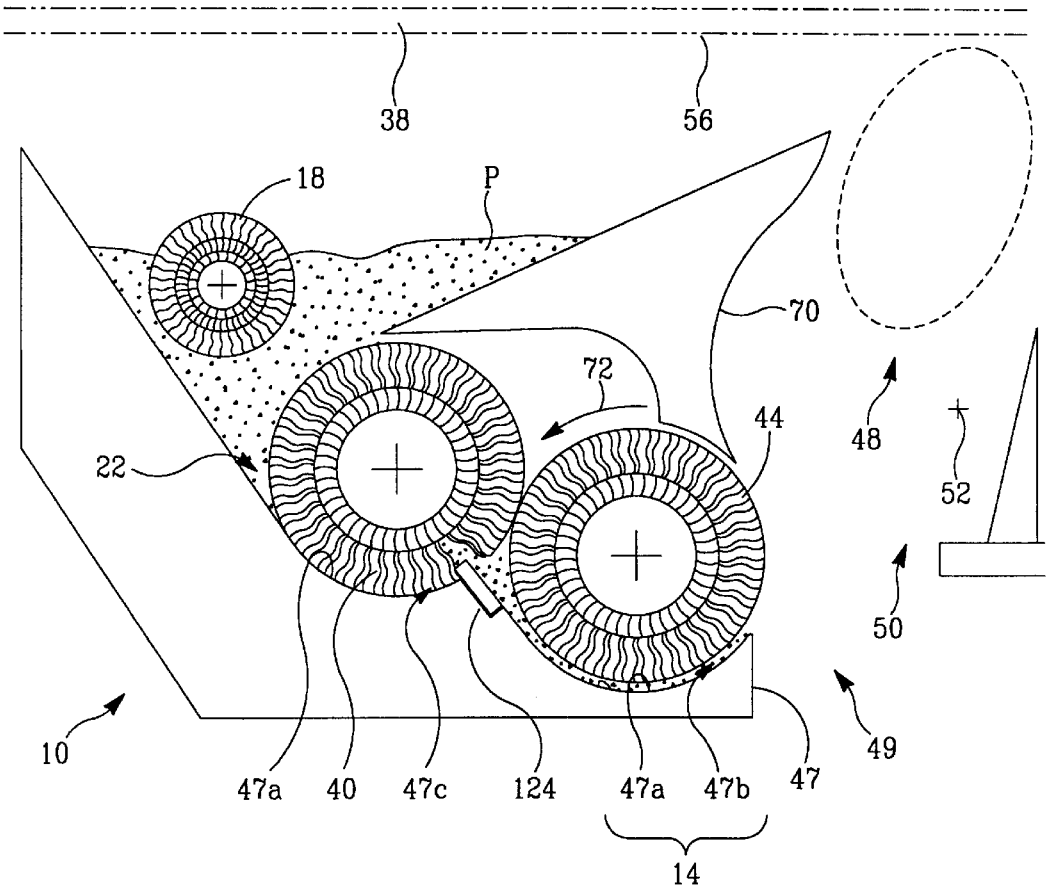
FIG. 6 is an elevational view of the apparatus illustrated in FIG. 5.

FIGS. 5 and 6 show an alternative embodiment of the present invention using the same reference numbers from FIGS. 1–4 to denote similar elements. Although the movable walls 26, 28 are present in the alternative embodiment, they are not illustrated in FIGS. 5 and 6.

As shown in FIGS. 5 and 6, a rotatable auger brush 18 is immersed in powder (P) in a powder supply and dispersing system 49 of a variable width web coating apparatus 51. The powder supply and dispersing system 49 causes particulates, such as thermoset, thermoplastic, and other finely divided material, to be electrostatically applied to the bottom surface 56 of the continuously moving target web 38. The apparatus 51 includes a powder feeder 10 with a discharge 22, through which powder is communicated by metering brush 40 to atomizing brush 44 for application ultimately onto target web 38.

The powder supply and dispersing system 49 includes a pan 47, a wing 70, and an atomizing brush 44. Atomizing brush 44 is journaled for rotation in the direction of arrow 72 about a generally horizontal axis 74. Atomizing brush 44 and pan 47 are spaced in order to define a venturi 47B therebetween, into which powder is fed from powder feeder 10.

In operation, the powder feeder 10 feeds powder to the atomizing brush 44 through the discharge 22, the metering path 47A, and the venturi 47B. As the brush 44 rotates and deagglomerates the powder, the powder is directed and aimed by wing 70 into the target volume 48 in an electrostatic coater 50. The powder is dispersed by brush 44 as a flowing dispersion. Once the dispersion is received within the target volume 48 of electrostatic coater 50, the dispersion will be under the influence of the electrical field and ionization of the charged electrodes 52 of the coater 50. Thus, the charged powder particles are caused to move by electrostatic attraction to the conductive grounded target web 38.

While this embodiment will be described as it is used with a specific electrostatic coating process, it should be understood that it might be used with other electrostatic coating systems. In addition, the present invention may be used in any coating operation where a uniform volume of a powder feeder is required and where the powder is highly reactive. An example of alternative electrostatic coating processes is disclosed in U.S. Pat. No. 5,314,090, which is hereby incorporated by reference.

In order to obtain a uniformly coated web 38, powder should be uniformly discharged by metering brush 40 across its length toward the discharge 22. Rotatable auger brush 18 is immersed within powder and extends at least the length of the powder feeder 10 in order to maintain a horizontally level supply of particulates therein. The feeder 10 has a limited volume, and its powder must be replenished as the powder is withdrawn by metering brush 40.

Figure 7:
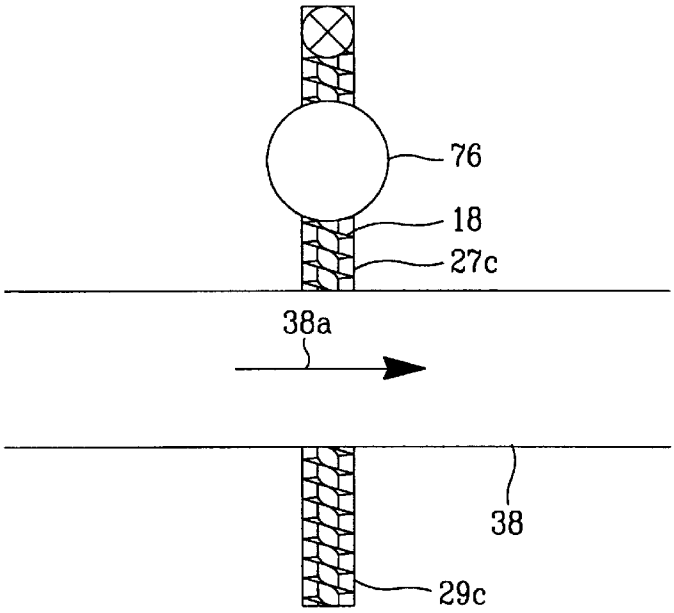
FIG. 7 is a top plan view of the cross feed auger of the present invention.
Figure 8:
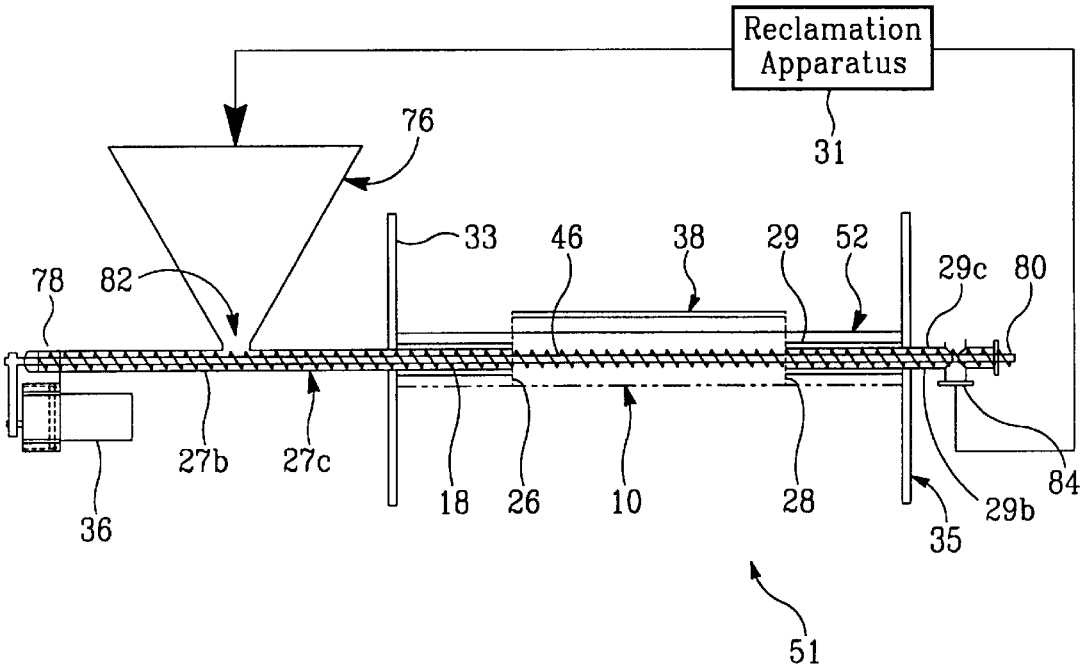
FIG. 8 is an elevational view of a coating apparatus according to the present invention.

Because of the limited space between the target web 38 and the powder feeder 10, it is difficult, if not impossible, to fit a powder supply hopper of practical size between the web 38 and the powder feeder 10 in order to permit replenishment of powder in feeder 10. Accordingly, as best shown in FIGS. 7 and 8, the horizontally disposed rotatable auger brush 18 transports powder from a powder supply hopper 76 to the powder feeder 10. The adjustable walls 26,28 can be moved linearly to adjust the discharge width (W) of the powder supply and dispersing system 49 shown in FIGS. 5–8 in substantially the same way as that which is shown in FIGS. 1–4.

The rotatable auger brush 18 is in the form of a screw conveyor, so that powder is moved from the supply hopper 76 to the powder feeder 10. In order to vary the flow of powder from the supply hopper 76 to the powder feeder 10, the auger speed may be varied, with normal operation causing brush 18 to rotate at about 100 RPM for a 2-inch diameter brush 18, for 5 pounds per minute of powder flow. The rotational speed and brush diameter should each be as small as possible in order to minimize undesirable shear forces on the powder particles. Additionally, the pitch of the flights of the bristles 42 of the auger brush 18 may also be increased to increase the flow of powder transported by brush 18 at a given speed. The auger brush 18 rotates continuously in order to maintain the powder feeder 10 filled. The powder carrying capacity of auger brush 18 is proportional to its pitch times the speed of rotation times its diameter. Because of the softness, flexibility, and small size of the bristles 42, low shear forces are imposed on the powder at the bristle/tube interface. The rotatable auger brush 18 is made from bristles 46, which are of a suitable length and spatial density to sweep the powder from supply hopper 76 to the powder feeder 10.

Auger brush 18 includes proximal end 78 journaled to electric motor 36, and a distal end 80 which extends laterally beyond the powder feeder 10. Brush 18 is exteriorly fixed at proximal end 78, and is supported at distal end 80 by the stationary feed tube 29B of the telescopic reclamation path 29C. The telescopic powder feed path 27C extends from proximal end 78 through the first end wall 33 of the feeder 10, and surrounds and encloses a first length of auger brush 18. The stationary feed tube 27B includes an aperture 82, from which powder is fed from the supply hopper 76. Supply hopper 76 is spaced from open proximal end 78 a distance sufficient to preclude spilling of the powder due to the angle of repose of the fluidized powder.

Auger brush 18 is coextensive with and immersed within the powder filling the powder feeder 10. Powder is dispensed throughout the length of the powder feeder 10 between the two adjustable walls 26,28. As brush 18 rotates, powder is withdrawn from hopper 76 and advanced longitudinally between the flights of the bristles 46 of brush 18. As the powder advances beyond wall 26, it enters the top of feeder 10, and may fall into feeder 10 should there be available space. The powder will fall into the first available location within feeder 10, ultimately causing all void spaces to fill. Preferably about 5% to about 10% powder in excess of that required to maintain feeder 10 filled is supplied to brush 18, in order to make certain that the feeder 10 is filled level between its adjustable walls 26 and 28. Upon initial operation, powder will first fill the feeder 10 adjacent adjustable wall 26, taking into account the angle of repose of the powder, and will continue to fill feeder 10 in the direction of adjustable wall 28. Thus, powder is evenly distributed throughout the powder feeder 10, insuring a uniform head pressure on metering brush 40 to permit a uniform coating to be applied to target web 38. Should an excess of powder not be supplied, then the feeder 10 at the end wall 35 will not maintain its head pressure. The flow rate through metering brush 40, as a result, will decrease, causing a thinner deposition on the target web 38 in that region.

Rotatable auger brush 18 is surrounded at its distal end 80 by the stationary feed tube 29B. The stationary feed tube 29B extends from within the powder flow tube 29 of the powder feeder 10 to distal end 80. The resulting telescopic powder reclamation path 29C allows the necessary excess particulates to be transported beyond powder feeder 10 when powder feeder 10 is filled. The powder reclamation path 29C and distal end 80 extend a distance from exit wall 35. Reclaim port 84 communicates with the stationary feed tube 29B and is connected to an appropriate reclamation apparatus 31 to return excess powder to supply hopper 76. A Doppler microwave frequency device, such as an Endress and Hauser Model DTR 131Z, insures that excess powder is being fed through powder feeder 10 at all times. Excess powder may be recycled back to supply hopper 76, increasing the powder utilization efficiency of the system.

The speed at which the auger brush 18 rotates is coordinated with the speed at which the metering brush 40 is rotated, such that continuous and adequate powder flows from the brush 18, to powder feeder 10, and from atomizing brush 44 to coater 50 to target web 38.

Powder paints are typically used to coat the surface of metal substrates. The powders may be thermoset resins, which react with only minimal energy input. However, it should be understood that the invention is not limited to the coating of metal substrates with thermoset resins. For instance, the present invention may be used for thermoplastic nylon deposition, cornstarch deposition to paper articles, and the like. While this invention has been described as it is used with a specific electrostatic coating process, it may be used in any coating operation where it is desirable to vary the discharge width. Though not limited to such arrangements, the present invention is especially useful where variations in the discharge width are desired without destroying the uniformity of the discharge, for example, to compensate for different widths of target web 38.

The illustrated embodiment with the auger brush 18 is particularly useful where a level volume of a powder feeder 10 is required, or where the powder is highly reactive. It is, understood, however, that the present invention is not limited to such an arrangement, nor is the illustrated embodiment limited to use under the described conditions.

Figure 9:
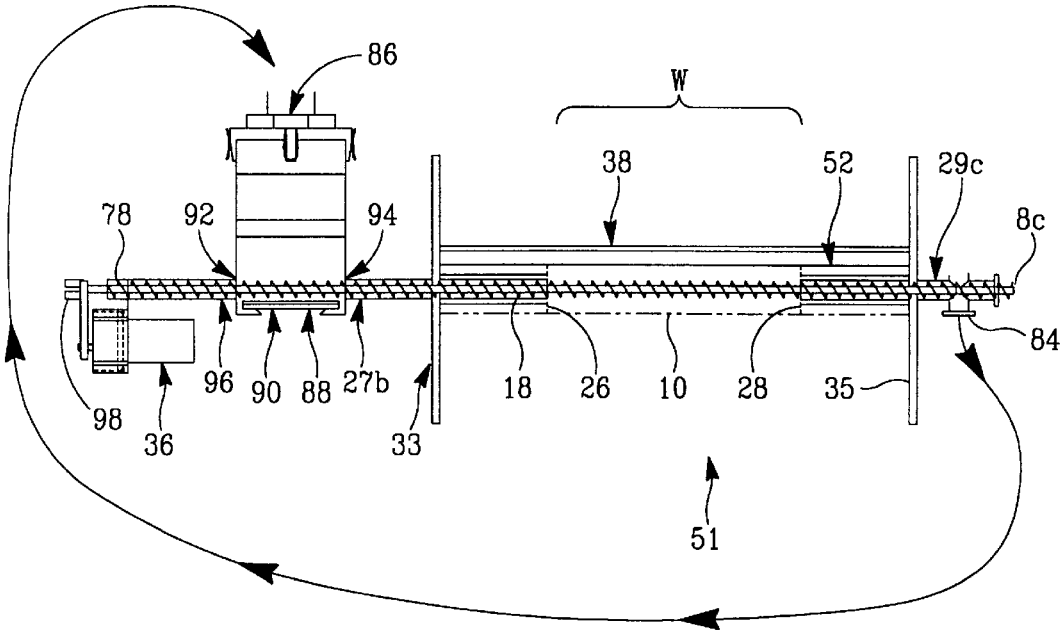
FIG. 9 is an elevational view of another coating apparatus according to the present: invention.

In the embodiment of FIGS. 7 and 8, the supply hopper 76 is conical in shape, and feeds powder through aperture 82 of stationary feed tube 27B. Alternatively, as best shown in FIG. 9, the supply hopper 76 may be rectangular in shape. FIG. 9 discloses an embodiment similar to that of FIGS. 5–8, so like numbers refer to like components.

In the embodiment of FIG. 9, the discharge width (W) is adjusted in much the same way as in the embodiments of FIGS. 1–8. In particular, the adjustable walls 26,28 are moved linearly toward and away from each other to provide the desired adjustment width (W).

The powder is loaded into hopper 76 through opening 86. Along bottom surface 88, there is an air plenum 90, which bubbles fluid, such as air bubbles or inert gas, through the supply hopper 76 like in a fluidized bed. Air plenum 90 prevents the powder at the bottom 88 from packing or bridging. Air plenum 90 fluidizes the powder in the lower auger region of hopper 76, and thus enables the powder to flow more readily into the brush or auger 18 without introducing high shear forces. The plenum 90 may have several fluidizing sections along its length, so that different air flows may be applied to insure satisfactory filling of brush 18 without creating rat holes which detract from fluidization. Additionally, the pitch of auger brush 18 in the region of hopper 76 may be locally varied to promote uniform lateral filling.

The supply hopper 76 includes a first aperture 92 and a second aperture 94, with brush 18 extending therethrough. Tube 96 surrounds rotatable auger brush 18 between its open proximal end 78 and aperture 92. Stationary feed tube 27B surrounds the brush 18 from aperture 94 through end wall 33. Tube 96 is of sufficient length to preclude the powder from spilling out its open end. Auger brush 18 is supported for rotation by exterior bearings 98.

Occasionally, a coating is desired on both sides of a target web 38. The present invention therefore also provides a dual-side coating apparatus for applying a uniform coating on opposite first and second sides of the target web 38.

Figure 10:
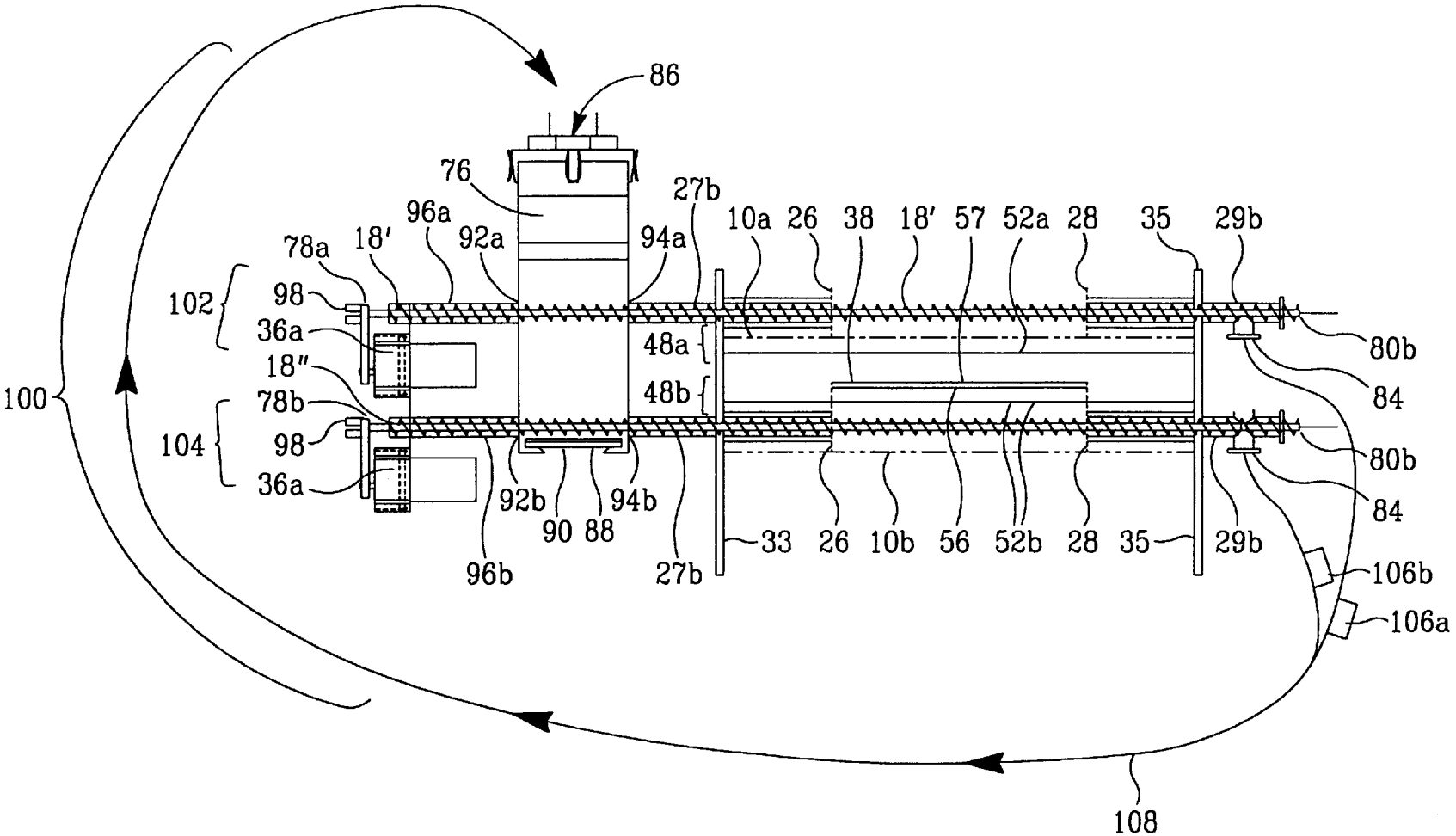
FIG. 10 is an elevational view of a coating apparatus for electrostatically coating the top and bottom surfaces of a substrate according to the present invention.

As best shown in FIG. 10, the dual-side coating apparatus 100 includes at least one powder supply hopper 76 for holding a supply of powder, and two sets 102,104 of any of the coating apparatuses 51 illustrated in FIGS. 1–9. One set 102 is located generally above the target web 38, while the other set 104 is located generally below the web 38.

A first powder discharging device (e.g., of the type denoted by reference number 14 in FIGS. 1, 3, 5 and 6) disperses powder in a substantially uniform manner across a first target volume 48A. The first target volume 48A is located on a top side of the target web 38. Located in the first target volume 48A is a first electrostatic coater having electrodes 52A. The first electrostatic coater electrostatically coats the top side 57 of the target web 38 in a substantially uniform manner using the powder which is dispersed by the first powder discharging device.

A first powder feeder 10A selected from any one of the previously described powder feeders 10 connects the powder supply hopper 76 to the first powder discharging device. The first powder feeder 10A feeds powder from the powder supply hopper 76 to the first powder discharging device.

A second powder discharging device (e.g., also of the type denoted by reference number 14 in FIGS. 1, 3, 5 and 6) disperses powder in a substantially uniform manner across a second target volume 48B which is located on the bottom side 56 of the target web 38. A second electrostatic coater having electrodes 52B in the second target volume 48B electrostatically coats the bottom side 56 of the target web 38 in a substantially uniform manner using the powder which is dispersed by the second powder discharging device.

A second powder feeder 10B connects the powder supply hopper 76 to the second powder discharging device. When activated, the second powder feeder 10B feeds powder from the powder supply hopper 76 to the second powder discharging device.

Each of the powder feeders 10A,10B preferably is implemented using a powder feeder 10 from one of the embodiments shown in FIGS. 1–9. It is understood, however, that other powder feeder arrangements can be used, especially in providing the coating apparatus 102 which is located above the web 38. In that particular apparatus 102, the head room is not as limited as when coating the bottom surface 56 of the web 38.

As shown in FIG. 10, when each of the powder feeders 10A,10B is provided using an arrangement similar to that of FIG. 9, the dual-side coating apparatus 100 includes, two rotatable auger brushes 18' and 18", and two motors 36A and 36B to drive each auger brush 18' and 18", respectively. The hopper 76 has a hopper inlet 86 and supplies powder to both powder feeders 10A, 10B using the rotatable auger brushes 18' and, 18", respectively. The supply hopper 76 therefore includes four apertures 92A, 92B,94A,94B. Apertures 92A and 94A are horizontally aligned, at opposite walls of supply hopper 76. Likewise, apertures 92B and 94B are horizontally aligned at opposite walls of supply hopper 76. Apertures 92A and 94A permit rotatable auger brush 18' to extend through hopper 76, so that powder may be transported from the supply hopper 76 to the powder feeder 10A. Likewise, apertures 92B and 94B provide an opening through which rotatable auger brush 18" extends, thereby permitting powder to be transported from the supply hopper 76 to the powder feeder 10B.

Auger brush 18' includes an open proximal end 78A, which is supported by bearings 98 and journaled to variable speed motor 36A, and a distal end 80A, which usually is supported by a respective stationary feed tube 29B. A portion of brush 18' is surrounded by tube 96A from proximal end 78A to aperture 92A of supply hopper 76. Tube 96A is of a length sufficient to prevent powder from spilling out its open end due to the angle of repose of the fluidized powder. Another portion of auger brush 18' is surrounded by stationary feed tube 27B, which extends from the aperture 94A of supply hopper 76 and through the end wall 33. Rotatable auger brush 18' also extends through and is coextensive with powder feeder 10A. Auger brush 18' has a portion which is surrounded by one of two stationary feed tubes 29B which extends from end wall 35 to distal end 80A. The tubes 29B are as short as possible, in order to prevent unneeded working of the powder. A reclaim port 84 communicates with each tube 29B, and redirects powder to the supply hopper 76. Operation of Doppler sensors 106A assure that some excess powder is fed at all times. Preferably, air plenum 90 percolates gas bubbles through the powder in hopper 76 to prevent bridging and packing, which can cause clumping and agglomeration of the powder.

Rotatable auger brush 18" likewise includes an open proximal end 78B, which is supported by exterior bearings 98 and journaled to variable speed motor 36B, and a distal end 80B, which is normally unsupported. A portion of rotatable auger brush 18" is surrounded by tube 96B, which extends from proximal end 78B to aperture 92B of supply hopper 76. Tube 96B is of a length sufficient to preclude powder released into the tube 96B from spilling out its open end. Another portion of auger brush 18" is surrounded by stationary feed tube 27B which extends from aperture 94B of supply hopper 76 through the end wall 33. Rotatable auger brush 18" extends above and is coextensive with the inlet of powder feeder 10B. Auger brush 18" has yet another portion which is surrounded by stationary feed tube 29B, which extends from the distal end 80B through the end wall 35. Reclaim port 84 communicates with Doppler sensor 106B and is connected to path 108. The powder from both stationary feed tubes 29B therefore is redirected to the supply hopper 76.

The cross feed auger brushes 18',18" permit the bottom and top sides 56,57 of the target web 38 to be coated uniformly, while maintaining a level and uniform supply of powder in the powder feeders 10A,10B. Thus, as powder is dispensed from powder feeders 10A, 10B, the powder is charged by electrodes 52A,52B to evenly coat the bottom and top sides 56,57 of the target web 38. At the same time, brushes 18',18" rotate in order to withdraw powder from hopper 76 and to replenish feeders 10A,10B with the withdrawn powder.

Preferably, variations in web width are compensated for by linearly moving the walls 26,28 in the same way as in the embodiments of FIGS. 1–9. If different coatings are desired on the different sides 56,57 of the web 38, different hoppers can be used to supply different types of powders to the feeders 10A,10B.

Figure 11:
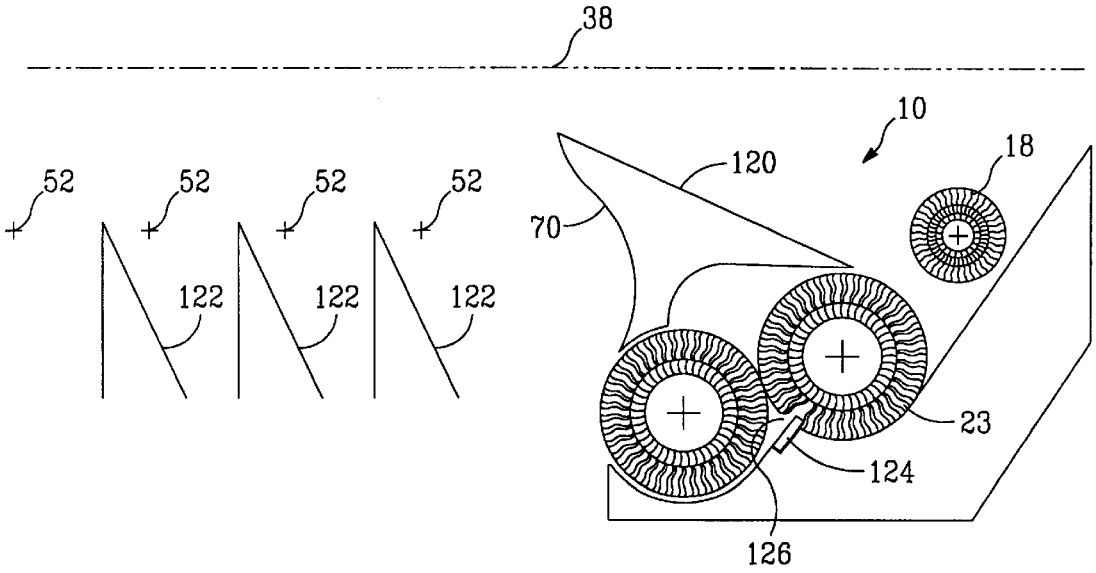
FIG. 11 is a fragmentary cross-sectional view of the embodiment illustrated in FIG. 5.

FIG. 11 is a fragmentary cross-sectional view according to FIG. 5, with like reference numerals designating like components. Preferably wing 70 has an upper surface 120 forming a forward stationary surface of powder feeder 10. Wing 70 is curved in order to direct the powder toward the electrodes 52 and web 38. Non-conductive baffles 122 are interposed between electrodes 52, in order to shape the dispersion of particles and the electric field, so that the charged powder is very efficiently applied to the web 38. The electrodes 52 and baffles 122 extend the maximum width of the web 38, so that powder is applied over the total exposed surface.

Preferably, cleaner 124, which may be another brush, extends the length of metering brush 40. Cleaner 124 extends inwardly into the bristles of the metering brush 40, in order to open the bristles and allow any remaining powder to fall therefrom. Thus, as the metering brush 40 rotates toward the powder receptacle 16, its bristles will be virtually empty, and ready to receive a uniform fill of powder throughout its length. Uniform application of powder to web 38 is best done with a horizontally level supply of powder carried by metering brush 40 in the region 126 for transfer to atomizing brush 44.

While this invention has been described as having a preferred design, it is understood that it is capable of further modifications, uses, and/or adaptations thereof following in general the principles of the invention including such departures that have been within known or customary practice in the art to which the invention pertains.

What I claim is:

1. A powder feeder and discharging system for feeding powder from a powder supply to a powder discharging device, comprising:

a powder receptacle having an inlet, a discharge for directing powder toward a powder discharging device, a stationary wall portion and at least one adjustable wall which is movable with respect to the stationary wall portion to adjust a width of the discharge;

a powder discharge device in communication with the discharge for directing powder toward an object to be coated; and a rotatable auger brush in communication with the powder supply and extending along the inlet of the powder receptacle, for withdrawing powder from the powder supply and transporting the powder through the inlet of the powder feeder.

2. The powder feeder and discharging system of claim 1, further comprising a drive mechanism operatively connected to the rotatable auger brush so as to rotate the rotatable auger brush.

3. The powder feeder and discharging system of claim 2, wherein the rotatable auger brush is driven by the drive mechanism using a rotational speed which causes the powder to be dispensed uniformly across the powder receptacle.

4. The powder feeder and discharging system of claim 1, wherein the rotatable auger brush is horizontally arranged in the powder receptacle.

5. The powder feeder and discharging system of claim 1, wherein said at least one adjustable wall includes a powder flow tube in communication with the powder receptacle and extending away from the powder receptacle, from an outside surface of said at least one adjustable wall, the rotatable auger brush being arranged so as to extend through the powder flow tube and transport powder therethrough.

6. The powder feeder and discharging system of claim 5, wherein the powder flow tube is fixed to said at least one adjustable wall for movement therewith.

7. The powder feeder and discharging system of claim 6, further comprising a stationary feed tube arranged so that the powder flow tube is telescopically movable along a portion of the stationary feed tube, the stationary feed tube being disposed around a portion of the rotatable auger brush so that the rotatable auger brush transports powder through the stationary feed tube.

8. The powder feeder and discharging system of claim 7, wherein the stationary feed tube and the powder flow tube extend toward the powder supply and together define a telescopic powder feed path of adjustable length which compensates for movement of said at least one adjustable wall.

9. The powder feeder and discharging system of claim 7, wherein the stationary feed tube and the powder flow tube extend generally away from the powder supply toward a powder reclamation apparatus and together define a telescopic powder reclamation path of adjustable length which compensates for movement of said at least one adjustable wall.

10. The powder feeder and discharging system of claim 1, wherein the powder receptacle has an elongated shape of substantially constant cross section over a length thereof, said at least one adjustable wall being disposed near a first longitudinal end of the powder feeder, for selective movement linearly toward an opposite longitudinal end of the powder feeder to thereby selectively adjust the width of the discharge.

11. The powder feeder and discharging system of claim 10, wherein said at least one adjustable wall includes a powder flow tube in communication with the powder receptacle and extending away from the powder receptacle, from an outside surface of said at least one adjustable wall, the rotatable auger brush being arranged so as to extend through the powder flow tube and transport powder therethrough.

12. The powder feeder and discharging system of claim 11, wherein the powder flow tube is fixed to said at least one adjustable wall for movement therewith.

13. The powder feeder and discharging system of claim 12, further comprising a stationary feed tube arranged so that the powder flow tube is telescopically movable along a portion of the stationary feed tube, the stationary feed tube being disposed around a portion of the rotatable auger brush so that the rotatable auger brush transports powder through the stationary feed tube.

14. The powder feeder and discharging system of claim 13, wherein the stationary feed tube and the powder flow tube extend toward the powder supply and together define a telescopic powder feed path of adjustable length which compensates for movement of said at least one adjustable wall.

15. The powder feeder and discharging system of claim 13, wherein the stationary feed tube and the powder flow tube extend generally away from the powder supply toward a powder reclamation apparatus and together define a telescopic powder reclamation path of adjustable length which compensates for movement of said at least one adjustable wall.

16. The powder feeder and discharging system of claim 11, wherein the powder flow tube has a first end fixed to said at least one adjustable wall, the powder feeder further comprising a slidable bulkhead fixed to a portion of the powder flow tube other than the first end for supporting that portion of the powder flow tube.

17. The powder feeder and discharging system of claim 16, further comprising:

at least one control rod connected to the slidable bulkhead so that actuation of said at least one control rod in a first direction moves the powder flow tube and said at least one adjustable wall inwardly to decrease the width of the discharge and actuation of said at least one control rod in a second, opposite direction moves the powder flow tube and said at least one adjustable wall outwardly to increase the width of the discharge.

18. The powder feeder and discharging system of claim 17, further comprising first and second end walls located at the first longitudinal end and the opposite longitudinal end, respectively, for delimiting a powder containment area, one of the first and second end walls having at least one aperture through which said at least one control rod extends.

19. The powder feeder and discharging system of claim 1, further comprising:

at least one control rod connected at least indirectly to said at least one adjustable wall so that actuation of said at least one control rod in a first direction moves said at least one adjustable wall inwardly to decrease the width of the discharge and actuation of said at least one control rod in a second, opposite direction moves said at least one adjustable wall outwardly to increase the width of the discharge.

20. The powder feeder and discharging system of claim 1, further comprising a metering brush rotatably mounted at the discharge, for feeding powder out through the discharge at an adjustable rate, the rate being adjustable by selectively adjusting a rotational speed of the metering brush.

21. The powder feeder and discharging system of claim 20, wherein the metering brush is substantially parallel to the rotatable auger brush.

22. The powder feeder and discharging system of claim 20, wherein:

the powder receptacle has an elongated shape of substantially constant cross section over a length thereof, said at least one adjustable wall being disposed near a first longitudinal end of the powder feeder, for selective movement linearly toward an opposite longitudinal end of the powder feeder to thereby selectively adjust the width of the discharge;

said at least one adjustable wall includes a powder flow tube in communication with the powder receptacle, fixed to said at least one adjustable wall for movement therewith, and extending away from the powder receptacle, from an outside surface of said at least one adjustable wall, the rotatable auger brush being arranged so as to extend through the powder flow tube and transport powder therethrough; and the powder feeder further comprises a stationary feed tube arranged so that the powder flow tube is telescopically movable along a portion of the stationary feed tube, the stationary feed tube being disposed around a portion of the rotatable auger brush so that the rotatable auger brush transports powder through the stationary feed tube.

23. The powder feeder and discharging system of claim 22, wherein the stationary feed tube and the powder flow tube extend toward the powder supply and together define a telescopic powder feed path of adjustable length which compensates for movement of said at least one adjustable wall.

24. The powder feeder and discharging system of claim 22, wherein the stationary feed tube and the powder flow tube extend generally away from the powder supply toward a powder reclamation apparatus and together define a telescopic powder reclamation path of adjustable length which compensates for movement of said at least one adjustable wall.

25. The powder feeder and discharging system of claim 22, wherein the discharging device includes an atomizing brush rotatably mounted adjacent to and substantially parallel to the metering brush, for receiving the powder from the metering brush and propelling the powder in a substantially uniformly distributed manner towards a target volume.

26. The powder feeder and discharging system of claim 20, wherein the discharging device includes including an atomizing brush rotatably mounted adjacent to and substantially parallel to the metering brush, for receiving the powder from the metering brush and propelling the powder in a substantially uniformly distributed manner towards a target volume.

27. A powder feeder and discharging system for feeding powder from a powder supply to a powder discharging device, comprising:

a powder receptacle having an inlet, a discharge for directing powder to a powder discharging device, a stationary wall portion and two adjustable walls disposed on opposite ends of the powder receptacle, each of the two adjustable walls being movable with respect to the stationary wall portion to adjust a width of the discharge;

a powder discharge device in communication with the discharge for directing powder toward an object to be coated; and a rotatable auger brush in communication with the powder supply and extending along the inlet of the powder receptacle, for withdrawing powder from the powder supply and transporting the powder through the inlet of the powder feeder.

28. A powder supply and dispersing system comprising:

a powder supply hopper for holding a supply of powder;

a powder discharging device for dispersing the powder in a substantially uniform manner across a target volume; and a powder feeder connecting the powder supply hopper to the powder discharging device, for feeding powder from the powder supply hopper to the powder discharging device, wherein the powder feeder includes:

a powder receptacle having an inlet, a discharge to which the powder is directed by the powder discharging device, a stationary wall portion and at least one adjustable wall which is movable with respect to the stationary wall portion to adjust a width of the discharge; and a rotatable auger brush in communication with the powder supply hopper and extending along the inlet of the powder receptacle, for withdrawing powder from the powder supply hopper and transporting the powder through the inlet of the powder feeder.

29. A powder supply and dispersing system comprising:

a powder supply hopper for holding a supply of powder;

a powder discharging device for dispersing the powder in a substantially uniform manner across a target volume; and a powder feeder connecting the powder supply hopper to the powder discharging device, for feeding powder from the powder supply hopper to the powder discharging device, wherein the powder feeder includes:

a powder receptacle having an inlet, a discharge to which the powder is directed by the powder discharging device, a stationary wall portion and two adjustable walls disposed on opposite ends of the powder receptacle, each of the two adjustable walls being movable with respect to the stationary wall portion to adjust a width of the discharge; and a rotatable auger brush in communication with the powder supply hopper and extending along the inlet of the powder receptacle, for withdrawing powder from the powder supply hopper and transporting the powder through the inlet of the powder feeder.

30. A coating apparatus for applying a uniform coating on a target web, the coating apparatus comprising:

a powder supply hopper for holding a supply of powder;

a powder discharging device for dispersing the powder in a substantially uniform manner across a target volume;

an electrostatic coater in the target volume for electrostatically coating the target web in a substantially uniform manner using the powder which is dispersed by the powder discharging device; and a powder feeder connecting the powder supply hopper to the powder discharging device, for feeding powder from the powder supply hopper to the powder discharging device, wherein the powder feeder includes:

a powder receptacle having an inlet, a discharge to which the powder is directed by the powder discharging device, a stationary wall portion and at least one adjustable wall which is movable with respect to the stationary wall portion to adjust a width of the discharge; and a rotatable auger brush in communication with the powder supply hopper and extending along the inlet of the powder receptacle, for withdrawing powder from the powder supply hopper and transporting the powder through the inlet of the powder feeder.

31. A coating apparatus for applying a uniform coating on a target web, the coating apparatus comprising:

a powder supply hopper for holding a supply of powder;

a powder discharging device for dispersing the powder in a substantially uniform manner across a target volume near the target web;

an electrostatic coater in the target volume for electrostatically coating the target web in a substantially uniform manner using the powder which is dispersed by the powder discharging device; and a powder feeder connecting the powder supply hopper to the powder discharging device, for feeding powder from the powder supply hopper to the powder discharging device, wherein the powder feeder includes:

a powder receptacle having an inlet, a discharge to which the powder is directed by the powder discharging device, a stationary wall portion and two adjustable walls disposed on opposite ends of the powder receptacle, each of the two adjustable walls being movable with respect to the stationary wall portion to adjust a width of the discharge; and a rotatable auger brush in communication with the powder supply hopper and extending along the inlet of the powder receptacle, for withdrawing powder from the powder supply hopper and transporting the powder through the inlet of the powder feeder.

32. A dual-side coating apparatus for applying a uniform coating on opposite first and second sides of a target web, the dual-side coating apparatus comprising:

at least one powder supply hopper for holding a supply of powder;

a first powder discharging device for dispersing the powder in a substantially uniform manner across a first target volume on the first side of the target web;

a first electrostatic coater in the target volume for electrostatically coating the first side of the target web in a substantially uniform manner using the powder which is dispersed by the first powder discharging device;

a first powder feeder connecting said at least one powder supply hopper to the first powder discharging device, for feeding powder from said at least one powder supply hopper to the first powder discharging device;

a second powder discharging device for dispersing the powder in a substantially uniform manner across a second target volume on the second side of the target web;

a second electrostatic coater in the target volume for electrostatically coating the second side of the target web in a substantially uniform manner using the powder which is dispersed by the second powder discharging device;

a second powder feeder connecting said at least one powder supply hopper to the second powder discharging device, for feeding powder from said at least one powder supply hopper to the second powder discharging device;

wherein the first powder feeder includes:

a powder receptacle having an inlet, a discharge to which the powder is directed by the first powder discharging device, a stationary wall portion and at least one adjustable wall which is movable with respect to the stationary wall portion to adjust a width of the discharge; and a first rotatable auger brush in communication with said at least one powder supply hopper and extending along the inlet of the first powder receptacle, for withdrawing powder from the at least one powder supply hopper and transporting the powder through the inlet of the first powder feeder.

33. A dual-side coating apparatus for applying a uniform coating on opposite first and second sides of a target web, the dual-side coating apparatus comprising:

at least one powder supply hopper for holding a supply of powder;

a first powder discharging device for dispersing the powder in a substantially uniform manner across a first target volume on the first side of the target web;

a first electrostatic coater in the target volume for electrostatically coating the first side of the target web in a substantially uniform manner using the powder which is dispersed by the first powder discharging device;

a first powder feeder connecting said at least one powder supply hopper to the first powder discharging device, for feeding powder from said at least one powder supply hopper to the first powder discharging device;

a second powder discharging device for dispersing the powder in a substantially uniform manner across a second target volume on the second side of the target web;

a second electrostatic coater in the target volume for electrostatically coating the second side of the target web in a substantially uniform manner using the powder which is dispersed by the second powder discharging device;

a second powder feeder connecting said at least one powder supply hopper to the second powder discharging device, for feeding powder from said at least one powder supply hopper to the second powder discharging device;

wherein the first powder feeder includes:

a powder receptacle having an inlet, a discharge to which the powder is directed by the first powder discharging device, a stationary wall portion and two adjustable walls disposed on opposite ends of the first powder receptacle, each of the two adjustable walls being movable with respect to the stationary wall portion to adjust a width of the discharge; and a first rotatable auger brush in communication with said at least one powder supply hopper and extending along the inlet of the first powder receptacle, for withdrawing powder from the at least one powder supply hopper and transporting the powder through the inlet of the first powder feeder.

34. A powder application system, comprising:

a powder feeder atomizer including a supply hopper, a powder feeder spaced from the supply hopper and having an inlet and a discharge, a rotatable auger brush in communication with the supply hopper and extending across the inlet for causing powder to be withdrawn from the supply hopper and to be transported longitudinally to the powder feeder and to be dispensed level across the powder feeder through the inlet, a drive for rotating the brush, and at least one adjustable wall which is movable to adjust a width of the discharge; and an application chamber in communication with the powder feeder atomizer, the application chamber having a substrate inlet aligned with a substrate exit, a plurality of charging electrodes arrayed in the chamber for charging powder supplied by the powder feeder atomizer, and a plurality of baffles disposed within the chamber interposed with the electrodes for shaping a dispersion of powder and an electric field resulting from the electrodes so that powder is attracted to and caused to be attached to substrates disposed within the chamber.

35. A powder feeder assembly for feeding powder from a powder supply to a powder discharging device, the powder feeder assembly comprising a powder receptacle having an inlet, a discharge for directing powder toward the powder discharging device, a stationary wall portion, at least one adjustable wall which is movable linearly and horizontally along the stationary wall portion in a direction parallel to the inlet to adjust a width of the discharge, and a powder feeder extending along the inlet for supplying powder to the receptacle, wherein the inlet is coextensive with an operative length of the discharge.

36. A powder feeder assembly for feeding powder from a powder supply to a powder discharging device, the powder feeder assembly comprising a powder receptacle having an inlet, a discharge for directing powder toward the powder discharging device, a stationary wall portion, two adjustable walls which are movable linearly and horizontally along the stationary wall portion in a direction parallel to the inlet to adjust a width of the discharge, and a powder feeder extending along the inlet for supplying powder to the receptacle, wherein the inlet is coextensive with an operative length of the discharge.

* * * * *